US005257525A

United States Patent [19]

Clarke

[11] Patent Number: 5,257,525

[45] Date of Patent: Nov. 2, 1993

[54] PORTABLE SLIM-LINE HOSE FITTING CRIMPER

[75] Inventor: John P. Clarke, Red Oak, Tex.

[73] Assignee: Atco Products, Inc., Ferris, Tex.

[21] Appl. No.: 903,613

[22] Filed: Jun. 24, 1992

[51] Int. Cl.[5] ..... B21D 41/04

[52] U.S. Cl. ..... 72/402; 72/416; 72/454; 29/237; 403/154; 403/405.1

[58] Field of Search ..... 72/454, 402, 416, 481; 29/237; 403/154, 155, 405.1, 316; 59/88

[56] References Cited

U.S. PATENT DOCUMENTS

| | | | |
|---|---|---|---|
| 2,801,560 | 8/1957 | Spangler | 72/454 |
| 2,903,929 | 9/1959 | McVey | 81/15 |
| 2,917,956 | 12/1959 | Merion | 72/454 |
| 3,117,615 | 1/1964 | Graven | 72/416 |
| 3,281,926 | 11/1966 | Frastaci et al. | 29/203 |
| 3,610,016 | 10/1971 | Bultman | 72/317 |
| 3,750,452 | 8/1973 | Frank | 72/402 |
| 3,771,343 | 11/1973 | Dawson | 72/402 |
| 4,192,171 | 3/1980 | Hamilton | 72/416 |
| 4,400,967 | 8/1983 | Owens | 72/402 |
| 4,773,788 | 9/1988 | Ruhl | 403/405.1 |
| 4,785,656 | 11/1988 | Kennedy | 29/237 |
| 4,887,451 | 12/1989 | Hoff et al. | 72/402 |
| 5,069,058 | 12/1991 | Hyatt | 72/402 |

FOREIGN PATENT DOCUMENTS

| | | | |
|---|---|---|---|
| 63325 | 4/1986 | Japan | 72/416 |
| 706174 | 2/1978 | U.S.S.R. . | |
| 1199343A | 7/1983 | U.S.S.R. . | |
| 1199343A | 7/1983 | U.S.S.R. . | |
| 8029 | 12/1909 | United Kingdom | 72/454 |
| 1405373 | 9/1975 | United Kingdom | 72/416 |

*Primary Examiner*—Daniel C. Crane

*Attorney, Agent, or Firm*—Ross, Howison, Clapp & Korn

[57] ABSTRACT

A slim-line portable hose ferrule crimper is formed by a bar with a pair of spaced parallel tracks extending from one side thereof. A movable crimping die holder holding a crimping die half is mounted on the tracks adjacent the bar, and is moved back and forth by a threaded screw passing through the bar and into the movable holder. A stationary holder for a complementary second die half confronting the movable holder is releasably secured at a fixed location on the tracks, but may be released by a pivoting latch to permit its removal from the apparatus.

8 Claims, 2 Drawing Sheets

PORTABLE SLIM-LINE HOSE FITTING CRIMPER

TECHNICAL FIELD OF THE INVENTION

This invention relates to tools for crimping ferrule fittings on the ends of flexible hoses. More particularly, it relates to a portable device of this type for producing a "bubble crimp" in a wide variety of fittings, including ones with odd-angled, or otherwise awkward to handle, plumbing arrangements.

BACKGROUND OF THE INVENTION

The use of crimped fittings to provide flow connection couplings to the ends of flexible hosing is widely practiced. One example of flexible hoses in which such connections are used is in vehicle air conditioning systems, wherein a refrigerant such as freon is circulated by the hoses. The provision of leak-tight connections at the hose ends is a matter of great concern in this industry.

The typical hose fitting has a tubular insert which slides into the hose, and a sleeve or ferrule which surrounds the end of the hose. The connection is secured by crimping the ferrule tightly about the end of the hose, so that the hose is gripped between the tubular insert and the ferrule.

One portable device for accomplishing the crimping step is disclosed in U.S. Pat. No. 4,192,171, owned by the assignee of this invention. That patent shows a tool for crimping a ferrule fitting which employs a barbed tubular insert as part of the fitting. The device is not suitable, however, for producing a fluid tight crimp with a hose fitting which employs a smooth or grooved tubular insert. There exists a need for a relatively simple and portable device suitable for producing leak-tight bubble crimps on fittings being connected to a hose. While relatively heavy equipment is known for this purpose, no one to our knowledge has produced a relatively inexpensive device which is lightweight and may be operated while hand-held, including in situ under an automobile hood. The device of this invention satisfies these criteria and is adapted to ready use even where the tubing system being treated has odd-angles or otherwise is awkward to place in a crimper.

One object of this invention is to provide a relatively simple and inexpensive portable device for use in repair of hose units employing hose fittings. The invention also serves the objective of providing a crimper which may be operated on a wide variety of couplings, including those of odd shape or unusual geometric configuration, to secure them by bubble crimping to a hose.

SUMMARY OF THE INVENTION

In accordance with the invention, there is provided a slim-line portable hose ferrule crimper which may be held in the hand. The crimper includes a bar and a pair of spaced parallel tracks extending from one side thereof. A first die holder is mounted on the tracks for holding the first half of a crimping die set in position between the tracks. A second die holder is secured releasably at a fixed location on the tracks spaced from the bar, for holding a second half of the die crimping set in confronting relation to the first half of the die crimping set. A threaded activator extends through the bar and engages the first die holder for causing movement of the first die holder with respect to the bar toward the second die holder to effectuate a bubble crimp of a ferrule positioned between the two die holders. A latch securing the second die holder in position on the tracks is actuatable to release the second die holder for removal thereof from the apparatus, simplifying the positioning of the connector to be crimped.

In a specific embodiment, each track of the crimper is provided with a recessed locking shoulder and the latch comprises a latch plate carried by the second die holder for engaging the locking shoulder of each track, so that the second die holder may be securely positioned in a stationary fixed position on the tracks. The latch plate is movable to disengage from the track shoulders and release the second die holder.

In a particular form of the invention, the latch plate is formed with opposed hooks at its ends for engaging the track locking shoulder, and is pivotally mounted on the second die holder so that the hooks may be swung away from the tracks.

In a specific embodiment, the threaded activator is provided with a fitting for engagement by an impact wrench, and is interconnected with the first die holder by a pair of pins extending through the first die holder to engage a locating shoulder provided near one end of the activator.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 2:
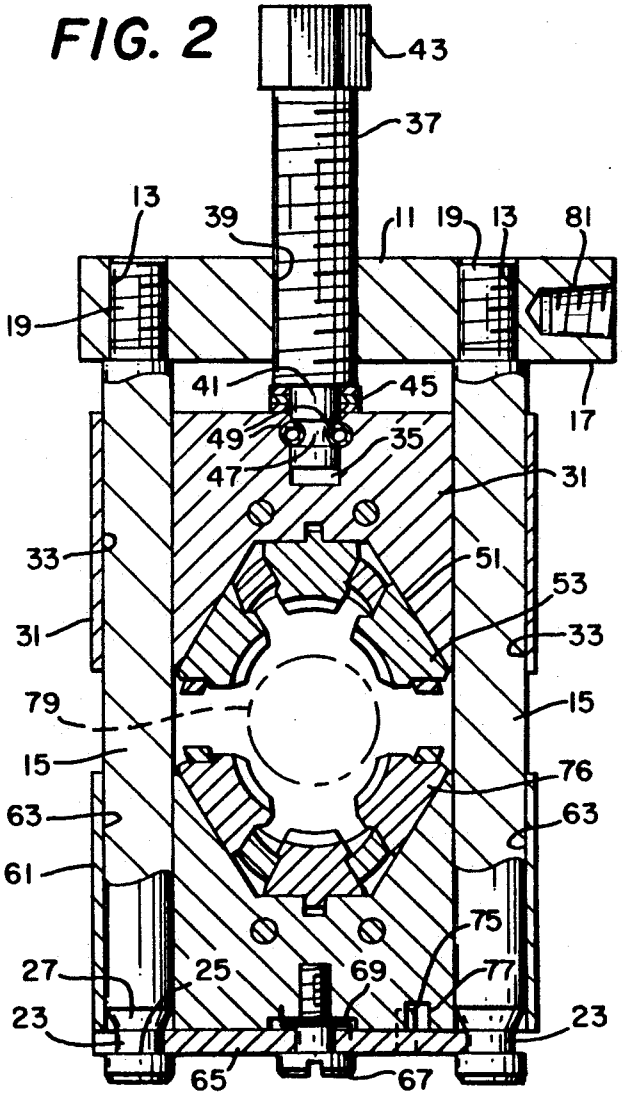
FIG. 2 is a cross-sectional view taken along the line 2—2 in FIG. 1.

An embodiment of the hand-held crimper constructed in accordance with the invention as illustrated in the drawings, includes a bar 11 having a pair of threaded track-receiving apertures 13 formed therein. A pair of guide tracks in the form of solid rods 15 extend from face 17 of bar 11. The tracks 15 are provided with threaded ends 19 for securement in track receiving apertures 13. Wrench flats 21 are provided on tracks 15 for tightening track 15 securely in apertures 13. Near the end of each track 15 remote from bar 11 is provided a latching recess 23. Each recess 23 is defined by a shoulder 25 at right angles to the axis of tracks 15 on the side of recess 23 remote from bar 11. At the opposite side of recess 23, a frustoconical surface 27 provides the transition between the narrow diameter of recess 23 and the full diameter of the track 15.

Figure 1:
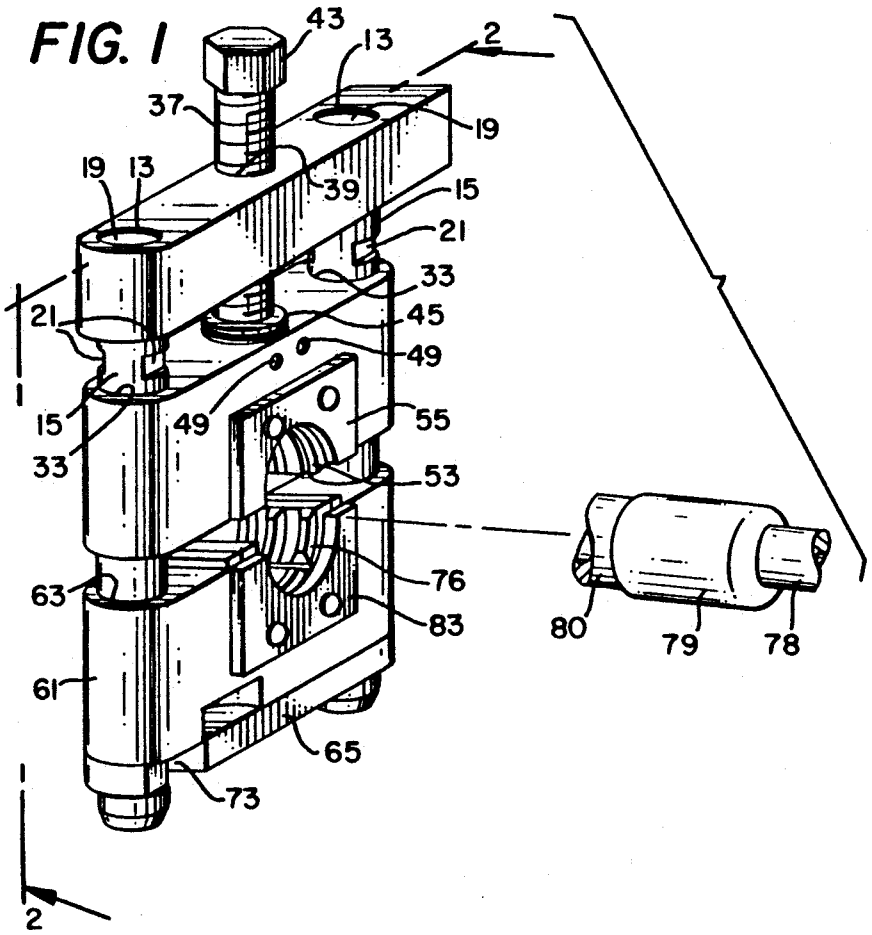
FIG. 1 is a perspective view of a slim-line portable crimper constructed in accordance with the invention.
Figure 3:
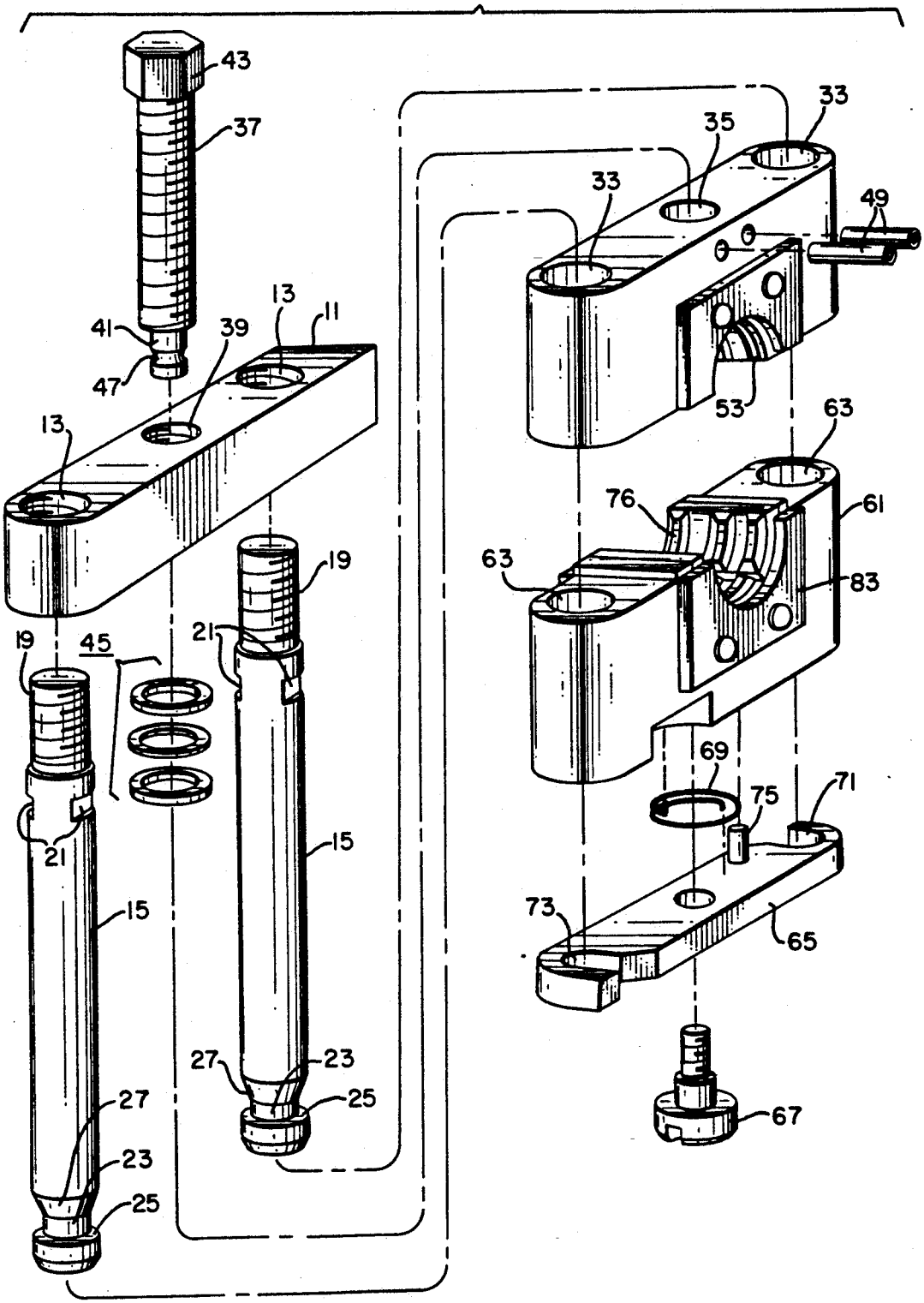
FIG. 3 is an exploded perspective view of the device depicted in FIG. 1.

A first actuatable die holder 31 is mounted on tracks 15 by means of apertures 33 therein which slide over tracks 15. Holder 31 is provided with a central aperture 35 for receiving an actuator screw 37 to cause crimping movement of first die holder 31. Actuator screw 37 extends through central threaded aperture 39 in bar 11, and has its reduced end 41 extending into aperture 35 in first die holder 31. The opposite end of actuator screw 37 is provided with a hex head 43 suitable for engagement by an impact wrench to cause rotation of screw 37 and thus translational movement of die holder 31. The reduced diameter end 41 of actuator screw 37 is provided with a thrust bearing-race set 45, and is coupled to die holder 31 at a locating recess 47 on actuator screw 37. A pair of roll pins 49 extend transversely through holder 31 and engage locating shoulder 47 to interconnect the die holder 31 with actuator screw 37. Die holder 31 is formed with a die-receiving recess 51 which releasably holds a conventional bubble crimping die half 53 between a pair of releasable plates 55 (only one of which is shown in FIGS. 1 and 3) in a conventional manner. The first die holder 31 thus presents one-half of a crimping die set facing away from bar 11 for movement up and down tracks 15 in accordance with rotation of actuator screw 37.

A second die holder 61 is releasably held on tracks 15 in a fixed location by positioning tracks 15 through apertures 63 on holder 61. The side of second holder 61 remote from bar 11 carries a latch plate 65 releasably securing second holder 61 in its fixed location on the tracks 15. Latch plate 65 is pivotally held by threaded pivot pin 67 secured into the body of second die holder 61 through spring 69. A pair of oppositely facing hooks 71 and 73 are formed on the ends of latch plate 65. When pivoted in one direction, latch plate 65 causes hooks 71 and 73 to engage the locking recesses 23 on the tracks 15 securing second die holder 61 in a fixed position. Locating pin 75 formed on latch plate 65 mates with a curved recess 77 in the end of holder 61 to guide the plate 65 as it pivots about pin 67 to release hooks 71 and 73 from tracks 15. When pivoted to the release position, the die holder 61 is free to be slid along tracks 15, and even removed from the apparatus if that is required for clearance to position a fitting to be crimped.

As in the case of die holder 31, holder 61 has a conventional crimping die half 76 which faces toward crimping die half 53 on holder 31. Crimping die half 76 is releasably held in position by side plates 83.

As indicated in FIG. 1, a fitting 78 having a crimpable ferrule 79 may be positioned over a hose 80. The ferrule is positioned between the die halves 53 and 76. The crimp is formed by turning actuator screw 37 to advance first die holder 31 and compress the die halves 53 and 76 around the ferrule 79.

The overall crimper is highly portable. Its major dimensions are only approximately six inches by twelve inches, and the thickness is less than two inches. It may be readily operated while hand held, or may be bench mounted by means of threaded aperture 81 on bar 11. It is so small and lightweight that it may be used to produce crimps in place under automobile hoods. Where the geometry of the fitting requires, second die holder 61 may be removed from the apparatus while the remainder of the apparatus is placed in position adjacent the ferrule to be crimped and the die holder 61 may then be positioned on the tracks 15 and locked into place by latch plate 65. Although completely removable, the latch plate arrangement, abutting as it does right angle shoulder 25, provides sufficient rigidity to support the substantial forces necessary to form a satisfactory bubble crimp.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A slim-line portable hose ferrule crimper comprising:

(a) a bar;

(b) a pair of spaced parallel tracks extending from one side of the bar;

(c) a first die holder mounted on the tracks for holding a first half of a crimping die set between the tracks;

(d) a second die holder secured releasably at a fixed location on the tracks spaced from the bar, for holding a second half of the die crimping set in confronting relation to the first half of the die crimping set; and (e) a threaded activator carried by the bar and secured at one end in the first die holder to interconnect the bar and first die holder whereby said activator, when turned, causes movement of the first die holder with respect to the bar toward and away from the second die holder; and (f) a latch movably carried by the second die holder to releasably secure the second die holder at a fixed location on the tracks by releasably engaging both of said tracks, and being releasable so that the second die holder and latch may be removed together from the apparatus.

2. The crimper of claim 1, wherein each of the tracks is provided with a recessed locking shoulder, and the latch comprises a latch plate carried by the second die holder for engaging the locking shoulder of each track, the latch plate being movable on the second die holder to disengage the latch plate from the shoulders.

3. The crimper of claim 2, wherein the latch plate is formed with opposed hooks at each end thereof for engaging the track locking shoulders, and is pivotally mounted on the second die holder so that the hooks may be swung away from the tracks.

4. The crimper of claim 1, further comprising a pair of releasable die locking plates positioned on each side of each die holder for releasably securing a crimper die half in position in each holder, and permitting removal and replacement of the crimping die halves.

5. The crimper of claim 1, further comprising a fitting on the threaded activator for engagement by an impact power wrench.

6. The crimper of claim 5, wherein the threaded activator extends into the first die holder and is provided with a recessed locating shoulder near its end extending into the first die holder, and further comprising a pair of pins extending through the first die holder at the locating shoulder of the activator, interconnecting the activator and first die holder.

7. A slim-line portable hose ferrule crimper comprising:

(a) a bar;

(b) a pair of spaced parallel tracks extending from one side of the bar and terminating in open ends remote from the bar;

(c) a movable die holder mounted on the tracks for holding a first half of a crimping die set between the tracks;

(d) a threaded activator extending through the bar and engaging the movable die holder for causing movement of the movable die holder toward and away from the bar;

(e) a stationary die holder secured releasably on the tracks near the open end thereof for holding a second half of the die crimping set in facing relation to the first half of the die crimping set; and (f) a latch carried pivotably on the stationary die holder, adapted to securing the stationary die holder in fixed position on the tracks, and being actuatable to release the stationary die holder and latch for removal together from the apparatus at the open end of the tracks, said latch being spring loaded with respect to the stationary die holder.

8. The crimper of claim 7, wherein each of the tracks is provided with a recessed locking shoulder, and the latch comprises a latch plate carried by the stationary die holder for engaging the locking shoulder of each track, the latch plate being pivotable on the stationary die holder to disengage from the shoulders.

* * * * *